US007001645B1

(12) United States Patent
Texier

(10) Patent No.: US 7,001,645 B1
(45) Date of Patent: Feb. 21, 2006

(54) MAGNETIC COATING, COATING METHOD WITH SAME AND COATING APPARATUS THEREFOR

(75) Inventor: Claude Texier, Thorigny-sur-Marne (FR)

(73) Assignee: Magnesia Industries Inc., Quebec (CA)

( * ) Notice: Subject to any disclaimer, the term of this patent is extended or adjusted under 35 U.S.C. 154(b) by 0 days.

(21) Appl. No.: 10/009,588

(22) PCT Filed: Jun. 9, 2000

(86) PCT No.: PCT/FR00/01604

§ 371 (c)(1),
(2), (4) Date: Sep. 10, 2002

(87) PCT Pub. No.: WO00/77803

PCT Pub. Date: Dec. 21, 2000

(30) Foreign Application Priority Data

Jun. 15, 1999 (FR) ..... 99 07589

(51) Int. Cl.
*B06D 3/00* (2006.01)

(52) U.S. Cl. ..... 427/547; 427/598; 427/128; 427/130; 427/131; 427/208.2; 427/407.1; 427/424; 118/696; 118/56; 118/324

(58) Field of Classification Search ..... 252/62, 252/54; 427/128, 130, 131, 132, 547, 598, 427/385.5, 424, 427, 123, 126.6, 208.2, 404, 427/407.1, 419.2, 600, 129; 118/324, 56, 118/696; 428/900
See application file for complete search history.

(56) References Cited

U.S. PATENT DOCUMENTS

| | | | | |
|---|---|---|---|---|
| 3,503,882 A * | 3/1970 | Fitch | 252/62.54 |
| 4,208,447 A * | 6/1980 | Bate et al. | 427/548 |
| 4,338,643 A * | 7/1982 | Tadokoro | 360/135 |
| 4,518,627 A * | 5/1985 | Foley et al. | 427/549 |
| 5,700,594 A * | 12/1997 | Jeffers | 428/694 BA |

FOREIGN PATENT DOCUMENTS

| | | |
|---|---|---|
| EP | 0508617 | 10/1992 |
| GB | 1444858 | 8/1976 |

* cited by examiner

*Primary Examiner*—Kirsten Jolley
(74) *Attorney, Agent, or Firm*—Clark & Brody

(57) ABSTRACT

The invention seeks to provide a magnetized coating suitable for exerting durable magnetic forces. To do this, the method of the invention consists in spreading conductive particles (13) on a medium (11), the particles being directed by prior magnetization along an inducing magnetic field and being embedded in a binder (12). The coating apparatus for implementing the method of the invention comprises means (10, 15) for feeding the medium (11) onto a conveyor (20), means for applying a main binder (12) via presser rollers (40) and via at least one nozzle (30), said means being coupled to heater means, a tank (50) of particles (13) coupled to a duster (51) for dispensing the fill of particles, means for spreading the fill of particles within the main binder, electromagnetic means (60) for producing an anisotropic magnetic field for magnetizing the particles, a sprayer (80) for depositing an additional binder, dryer means (100), demagnetizer means (110), and winder means (120). The invention is applicable to media particularly in paper-making, games, decoration, or building.

14 Claims, 2 Drawing Sheets

MAGNETIC COATING, COATING METHOD WITH SAME AND COATING APPARATUS THEREFOR

Figure 1:
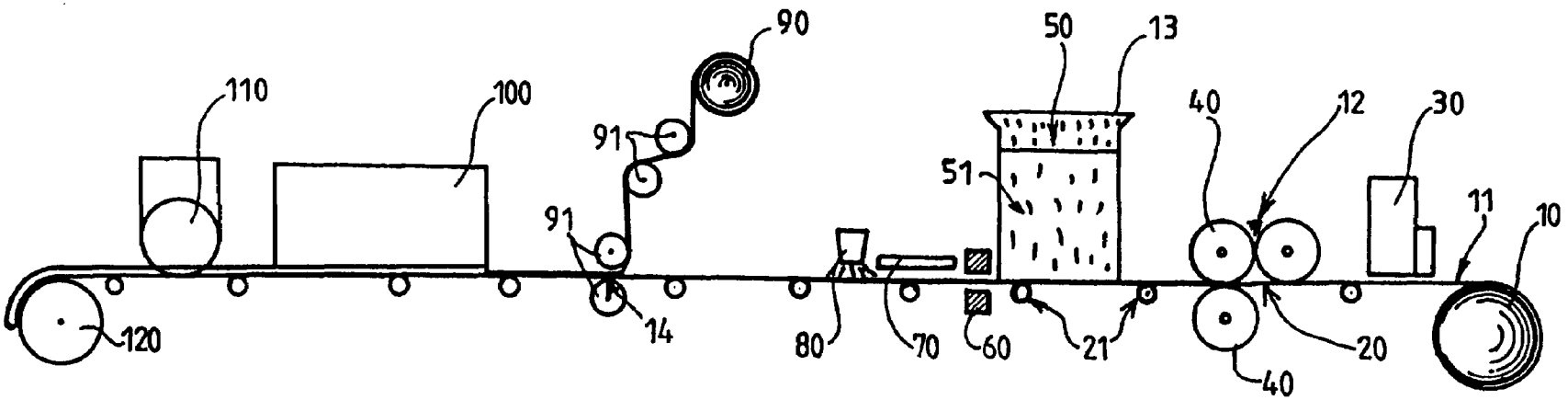

The present invention relates mainly to a magnetic coating, to a method of applying such a coating to outside surfaces, in particular of sheet or roll material, and to a coating apparatus implementing said method.

The invention applies to the field of games, in particular puzzles, board games, educational or teaching materials, to the field of paper-making, to decoration, or to building: wall coverings, removable fixing by means of magnetized elements, magnetic pressing or signaling means, covering plastered surfaces, e.g. surfaces of plaster board, or electromagnetic shielding. The invention also applies to the field of advertising, for example for outdoor and indoor posters or displays.

It is known, e.g. from document GB 1 444 858 A, to provide various objects with a magnetized surface so as to enable them to be fixed temporarily onto a ferromagnetic support, such as a refrigerator door, an armored door, or the like. Furthermore, iron sheets have been used as supports for games having magnetized pieces such as chess sets. Unfortunately, most surfaces such as walls, sheets of cardboard or the like, are not capable of retaining magnets. Similarly, it is not commonplace to have magnetic supports that are flexible and capable of being rolled up or folded.

The present invention seeks to mitigate those drawbacks by proposing a magnetic coating that generates an anisotropic medium enabling the sliding and the magnetic attraction forces exerted by the coating to be optimized, said coating being suitable for applying to any medium, in particular paper, card, sheets of flexible or rigid plastics material, wallpaper, walls, etc. The magnetic efficiency of the forces exerted by particles in an anisotropic medium is 25% to 30% greater than that obtained in an isotropic medium.

More precisely, the present invention provides a magnetic coating suitable for being spread substantially regularly over a surface, said coating comprising a binder having embedded therein conductive particles directed by prior magnetization along an inductive electromagnetic field, in particular ferromagnetic particles such as iron oxide particles.

In a particular embodiment, the coating of the invention serves to provide electromagnetic shielding serving firstly to confine electromagnetic waves emitted in a room, and secondly limiting the penetration of electromagnetic waves into said room. In this application in particular, non-ferromagnetic conductive particles, e.g. particles of copper, are added to or substituted for ferromagnetic particles, and the adhesive used as the main binder is preferably electrically conductive.

According to an advantageous characteristic, the conductive particles are rod-shaped so as to increase their ability to become directed along the inducing electromagnetic field.

In advantageous embodiments of said coating, said binder is an adhesive resin, in particular a hot-melt glue, a cold glue, or a paint. In order to avoid eddy currents forming, the adhesive resin is preferably not electrically conductive. For example it is possible to use adhesives in dispersion, in particular of the acrylic, vinyl acetate, or copolymers of vinyl acetate and acrylic styrene or ethylene type, adhesives in solution of the vinyl acetate, acrylic, or acrylic styrene type, vegetable glues, in particular of the starch, dextran, or casein type, or advantageously hot-melt glues made in particular on the basis of vinyl ethylene acetate, acrylic ethylene, polyolefin, styrene butadiene, or styrene isoprene.

The present invention also provides a method of applying such a coating onto a backing medium, the method comprising a step of applying a main binder on the medium while the medium is being guided by a conveyor, a step of controlled dispensing and uniform spreading of the fill of conductive particles in the resin, coupled with a step of directing the particles by magnetization, followed by a step of demagnetization, a step of covering the particles in a deposit of an additional binder, and a step of drying the assembly.

When the conductive particles are constituted at least in part by ferromagnetic particles, the magnetization step is followed by a demagnetization step so as to avoid disturbing subsequent steps, and the drying step is followed by a step of remagnetizing the particles.

In particular implementations:

- the controlled dispensing and spreading of the filler are implemented by programming the rate at which powder is delivered as a function of the density selected for the particles, and then by screening or measuring out the particles uniformly on the pre-glued medium; random distribution of the particles makes it possible for the top surface formed in this way to be of thickness that is controlled and uniform;
- the step of magnetization occurs once the particles are indeed spread through the main binder following the step of dispensing and spreading the particles, but before the binder actually sets by solidifying, so that the particles can still be directed; and
- the steps of dispensing, spreading, and magnetizing the particles are combined so that the particles are directed by magnetization prior to being actually spread through the binder.

An advantageous implementation consists in spraying an adhesive resin as a binder for covering the particles and in laminating a medium on the resulting top surface so as to act as a front medium. Any type of medium can be used as the front medium, in particular: card, paper, cloth, flexible or rigid plastics sheet material, etc., with the nature of the front medium being either identical to or different from that of the back medium.

Alternatively, when it is not possible to envisage using a front medium because the raw appearance of the back medium is to be conserved, then the covering step can advantageously consist in spraying on a varnish as the additional binder.

The invention also provides a coating apparatus for implementing the method of the invention, the apparatus comprising means for feeding the medium, which feeding can be continuous or discontinuous depending on whether the medium is in roll or sheet form, means for applying a main binder by means of presser rollers or by at least one nozzle, coupled to heater means, a tank of particles coupled to dusting means for dispensing the fill of particles, means for spreading the fill of particles through the main binder, electromagnetic means for producing an anisotropic magnetic field for magnetizing the particles, a sprayer for spraying on the additional binder, and drying means.

In preferred examples, the duster is programmed to deliver a quantity of powder corresponding to the density selected for the filler, said density preferably lying in the range 100 grams per square meter ($g/m^2$) to 900 $g/m^2$, the binder applicator means preferably delivering about 10 $g/m^2$ to 50 $g/m^2$ of binder, the spreading means being constituted by a system of vibrating screens or by at least one measuring-out device, suitable for forming particular patterns by masking, and the electromagnetic magnetization means are formed by an electromagnet.

In advantageous embodiments of said apparatus:

when the filler comprises at least some ferromagnetic particles, a demagnetizer is disposed immediately downstream from the electromagnetization means, and a final magnetizer is disposed downstream to the drying tunnel;

when the feed is performed continuously, the medium is fed from a winding-off roller, with the front medium where appropriate being fed likewise by a winding-off roller coupled to presser rollers on the conveyor, and a final winding roller delivers a roll of the product obtained by the method of the invention; and when the feed is performed discontinuously, the medium is fed sheet by sheet onto the conveyor from a feeder bin, and the front medium is fed where appropriate likewise from a sheet feeder bin, the feeder bins and the means for spreading the fill of particles being controlled by an automatic delivery system adjusted to a travel rate; and the binder applicator means and, where appropriate, the means for applying the additional binder, are adjusted by an optical sequential controller having photoelectric cells connected to the automatic delivery system.

Figure 2:
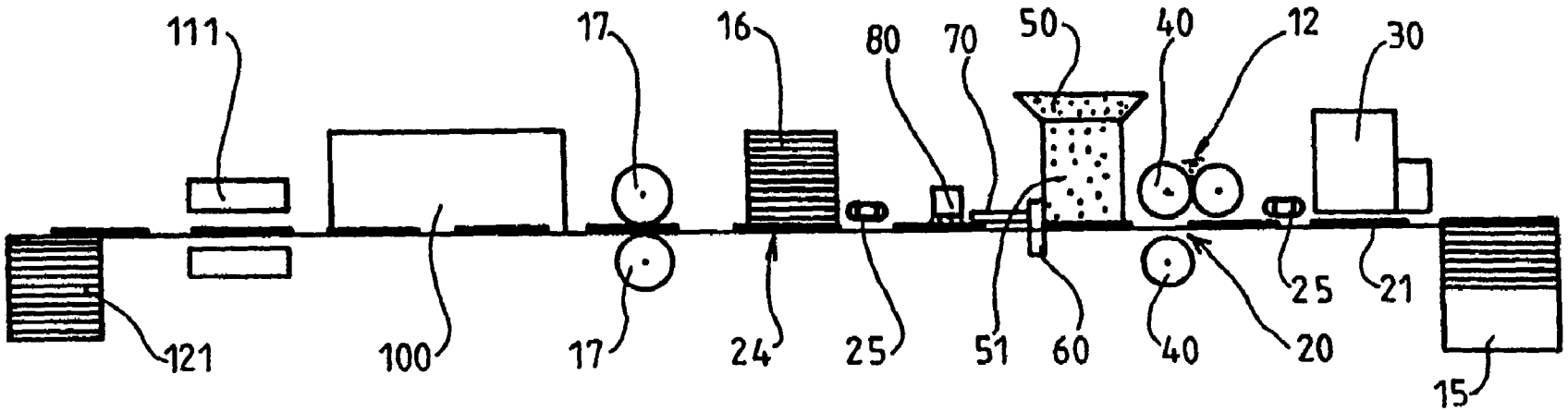

The present invention will be better understood from the following description and the accompanying figures given as non-limiting examples and showing:

FIG. 1 is a diagrammatic side view of an example of continuous coating apparatus for implementing the method of the invention; and FIG. 2 is a diagrammatic side view of an example of discontinuous coating apparatus for implementing the method of the invention.

In FIG. 1, the coating apparatus shown has various continuous workstations that are used in combination, in alternation, or optionally. The apparatus is a single-sided device, it being understood that two-sided apparatus would not go beyond the ambit of the present invention. The non-limiting example shown describes wallpaper being coated in order to illustrate how the apparatus operates.

The apparatus comprises a winding-off feed roll 10 for delivering backing paper 11, which roller is rotated by conventional means, the paper being guided by a continuous conveyor 20 driven to move in translation at the same speed by rotary elements 21. The linear speed lies in the range 30 meters per minute (m/min) to 250 m/min, for example, and preferably lies in the range 30 m/min to 150 m/min.

The conveyor 20 has hot-melt glue applicator means placed in register therewith in the form of a lip nozzle 30 coupled to heater means 31, and a machine having presser rollers 40 for applying cold or hot-melt glue 12. The binder applicator means preferably deliver about 10 g/m$^2$ to 50 g/m$^2$ of binder, and preferably about 35 g/m$^2$. One or other of these glue dispenser means is used, depending on the nature of the glue.

At the time of magnetization, the temperature used by hot-melt glues must be lower than the Curie temperature of the ferromagnetic material used. Hot-melt type glue has an application temperature lying in the range 140° C. to 190° C. A roller type machine, such as a machine including a Multiscan® 3960 generator sold by Nordson and connected by automatic heating pipes to automatic guns sold by the same company under the reference H20 can be used. The glue runs between two rollers 40 and via a calibrated space left between the rollers.

A tank 50 of particles 13 coupled to a duster 51 is then provided for dispensing ferromagnetic powder particles. The duster is programmed to deliver a quantity of powder that corresponds to the density selected for the filler, the mixture of the binder, typically a paint or a glue, and the ferromagnetic particles forming the filler in the binder corresponding to 200 g/m$^2$ to 850 g/m$^2$ of iron oxide, and preferably being substantially equal to 800 g/m$^2$ of iron oxide. Advantageously, the maximum quantity of ferromagnetic filler is used that can be accepted by the binder, e.g. six units by weight of ferromagnetic powder for two units by weight of binder.

For a material that is not to present any remanence, it is possible to use any ferromagnetic material capable of presenting the desired grain size and long-term stability, in particular chemical stability. For example, it is possible to use soft iron, quenched iron, ferrite, any iron oxide, ferromagnetic rare earth, samarium, barium, or cobalt. In a variant, iron particles are used that are covered in a material that provides protection against corrosion, e.g. a layer of cobalt. It is also possible to use chromium, chromium oxide, and the particles used for coating magnetic tapes.

The iron oxide particles used are in the form of elongate rods and present small grain size so as to obtain a smooth surface state. Excellent results have been obtained using iron oxide with grain size equal to 24 micrometers ($\mu$m), and smaller grain size are also suitable. If a grainy surface state is accessible, then it is possible to use larger grain sizes, e.g. lying in the range 25 $\mu$m to 300 $\mu$m.

A system of vibrating screens (not shown) is coupled to the duster 51 so as to spread the particles uniformly over the pre-glued backing paper. In a variant, a programmable measuring-out unit can be used so as to adapt the quantity of powder that is to be deposited. Deposition can be performed to occupy predetermined patterns by masking with pre-cutout stencils.

A magnetic field induced by an electromagnet 60 is created in order to use magnetization to direct the particles that have just been deposited in the adhesive resin, i.e. prior to the glue solidifying. The use of a hot-melt glue in this implementation is particularly advantageous since opening and closing thereof is easily controlled. Alternatively, the magnetic field is formed between the duster and the spreader means. This solution is advantageous when the powder used is of a kind that gives rise to a "wicking" phenomenon that can spoil the uniformity of the deposit on the paper.

Magnetization is performed by polarizing the particles magnetically. The coated paper passes through the air gap of the electromagnet 60 which generates a substantially uniform magnetic field across the entire width of the paper. By way of example, an electromagnet is used which generates an intense magnetic field that is substantially equal to 0.5 Teslas. It should be observed that care is taken to ensure that the viscosity of the covering of the present invention and the amplitude of the magnetic field are such as to avoid any migration of particles out from the binder so as to become stuck in the air gap of the electromagnet. Similarly, guide means (not shown) prevent the paper covered in the covering of the present invention sticking against one of the poles of the magnet, supposing a permanent magnet is used.

The coated paper then passes beneath a demagnetizer 70 placed immediately downstream from the electromagnetic magnetizing means.

If the coating constituted by the particle-filled resin is to be visible on the paper, then it can be advantageous to use a paint as the binder so as to provide a desired color. However the ferromagnetic particles can alter the color of the paint. If this effect is undesired, it is possible subsequently to cover it in one or more layers of paint having no ferromagnetic filler. A sprayer 80 then deposits additional binder. The flow rate of this sprayer is adjusted so that all of the particles are embedded in the binder. This binder could equally well be a varnish, e.g. a translucent varnish if it is desired to conserve a view of the backing paper in the background.

A front medium of paper is then deposited in this example, and the sprayer 80 is used to deliver glue as the additional binder. The front medium feed 14 takes place likewise from a winding-off roll 90 coupled to presser rollers 91 acting against the conveyor.

A drying tunnel 100 or in the alternative heater rollers, and a final magnetizer 110 located downstream from the drying tunnel are provided. The magnetizer is a drum coupled to rotate with the conveyor, having alternating north and south poles at a previously determined magnetic pitch. The travel speed and the magnetization speed is of the order of 80 m/min, the applied voltage is of the order of 2000 volts (V) to 3000 V, delivering a field of 8000 gauss to 9000 gauss for paper widths lying in the range 700 millimeters (mm) to 1400 mm.

A final winding roller 120 delivers a roll of the product obtained by method of the invention.

In order to provide shielding against electromagnetic radiation, it is advantageous to provide a fill of ferromagnetic particles that is sufficient to make the covering of the present invention conductive, at least at the frequencies which are to be eliminated. In a variant, non-ferromagnetic conductive particles are used, e.g. copper particles, either in addition to or as a replacement for ferromagnetic particles in order to form shielding or a Faraday cage. Such shielding makes it possible to protect electronic equipment, in particular telecommunications equipment and computer equipment from external disturbances, and also from eavesdropping by making it impossible to listen to the electromagnetic signals that are emitted by this type of equipment when in operation.

In FIG. 2, variant coating apparatus uses discontinuous type feed, and like the above-described apparatus it too presents various workstations that are used in combination, in alternation, or as options.

The paper is fed sheet by sheet 21 onto a conveyor 20 from a feeder bin 15, and the backing medium 24 is fed likewise from a sheet feeder bin 16 coupled to presser cylinders 17. The feeder bins, and the means for spreading the fill of particles which are identical to those described above, are controlled by an automatic dispenser system (not shown) of a type known to the person skilled in the art and adjusted to a travel rate. By way of example, the apparatus can apply glue to 90 cards per minute, with each card having an area of 40 centimeters (cm) by 55 cm.

The means 30 and 40 for applying binder and the means 80 for applying the additional binder are identical to those described above and are controlled by an optical sequential controller having photoelectric cells 25 connected to the automatic dispenser system.

In this embodiment, the final magnetizer 111 is in the form of an electromagnet and the storage system is in the form of a bin 121 suitable for stacking the sheets coated by the apparatus of the invention, e.g. optionally decorated sheets of paper, card, plastics sheets, or the like.

The invention is not limited to the embodiments described and shown. The method of the invention can also be used to adapt the thickness of the coating as a function of the weight of the two sheets to be stuck together. For example, when laminating a sheet weighing 90 grams (g) (per square meter) onto a sheet having the same thickness or greater thickness it is necessary to use 90 g to 120 g of coating. The magnetized coating of the magnet can also be adapted under the same conditions. In other words, the thickness of the coating can be well adapted to the appearance, the weight, the magnetic force, and the economic cost that are to be imparted.

It is also possible, in particular with discontinuous gluing, to deposit the covering solely in predefined zones or to magnetize only certain zones so as to ensure that magnets will become attached only in those predefined zones that also receive special marking corresponding, for example, to the correct replies to questions printed on the visible face of the medium. Magnetization in zones can be obtained by the magnet having air gaps with the shape of the desired zones, or by employing a set of electromagnets disposed in the form of a matrix and in powering only some of them.

It is also possible to cover both faces of a medium, typically of card or a plastics sheet, with the covering of the present invention so as to enable parts to be stacked. In a variant, a first face of the medium receives a non-magnetized covering while the opposite face receives a covering that can be magnetized. In a second variant embodiment, both faces receive a covering which is subsequently magnetized in permanent manner.

Furthermore, the apparatus of the invention advantageously includes means for cutting up the coated medium, e.g. for the purpose of forming magnet-type elements which, after being cut out, comprise a portion of medium relating to a subject or adapted to receive another medium relating to the subject, e.g. by means of glue. In this application, the resulting magnets are held on any metallic surface, e.g. a refrigerator door or on any surface (of paper, card, etc.) covered in a metal coating (coating containing metal in powder or filing or other form) or integrating a surface that is completely or partially made of metal (in strip form, a grid, etc.), by using magnetic forces created between the magnets and said metal surface.

The invention claimed is:

1. A method of applying a coating on a backing medium, the method comprising a step of applying a main binder on the medium while the medium is being guided by a conveyor, a step of controlled dispensing and uniform spreading of a fill of conductive particles in the binder, coupled with a step of directing the particles by magnetization, followed by a step of demagnetization, a step of covering the particles in a deposit of an additional binder, and a step of drying the assembly.

2. A method of applying a coating on a backing medium according to claim 1, wherein, when the fill of conductive particles comprises at least some ferromagnetic particles, the magnetization step is followed by a step of demagnetization, and the drying step is followed by a step of remagnetizing the particles.

3. A method of applying a coating on a backing medium according to claim 1, in which the controlled dispensing of the fill is performed by programming the powder delivery rate as a function of the density selected for particles.

4. A method of applying a coating on a backing medium according to claim 3, in which the magnetization step occurs after the particles have indeed been spread within the main binder following the step of dispensing and spreading the particles, but prior to the binder actually setting by solidifying.

5. A method of applying a coating on a backing medium according to claim 3, in which the steps of dispensing, of spreading, and of magnetizing the particles are combined in such a manner that the particles are directed by magnetization prior to being actually spread within the binder.

6. A method of applying a coating on a backing medium according to claim 1, in which an adhesive resin is sprayed as an additional binder covering the particles and to enable a medium to be laminated onto the top surface to serve as a front medium.

7. A method of applying a coating on a backing medium according to claim 1, in which the covering step consists in spraying a varnish as the additional binder.

8. Coating apparatus, the apparatus comprising means for feeding a medium onto a conveyor, means for applying a main binder via presser rollers and via at least one nozzle, said main binder applying means being coupled to heater means, a tank of particles coupled to a duster for dispensing the fill of particles, means for spreading the fill of particles within the main binder, electromagnetic means for producing an anisotropic magnetic field for magnetizing the particles, a spray for depositing an additional binder, a dryer means, and a demagnetizer placed immediately downstream from the electromagnetic magnetizing means and a final magnetizer is placed downstream from the dryer means, when the fill comprises at least some ferromagnetic particles.

9. Coating apparatus according to claim 8, in which the duster is programmed to deliver the quantity of powder that corresponds to the density selected for the fill, the spreader means are constituted by a system of vibrating screens, and the electromagnetic magnetization means are formed by an electromagnet.

10. Coating apparatus according to claim 8, in which the spreader means includes at least one measuring-out unit for forming particular patterns by masking using the particles.

11. Coating apparatus according to claim 8, in which, when feeding is performed continuously, the medium is fed from a winding-off roll, a front medium is fed from another winding-off roll coupled to other presser rollers pressing on the conveyor, and a final winding roll provides a reel of the resulting coated medium.

12. Coating apparatus according to claim 8, in which, when feeding is performed discontinuously, the backing medium is fed sheet by sheet onto the conveyor from a feeder bin, and a front medium is fed likewise from a sheet feeder bin, the feeder bins and the means for spreading the fill of particles being controlled by a dispenser system that is automatic and adjusted to the rate of throughput.

13. Coating apparatus according to claim 12, in which the means for applying the main binder and the means for applying the additional binder are governed by an optical sequential controller having photoelectric cells, and connected to the automatic dispenser system.

14. Coating apparatus according to claim 8, in which means are provided for cutting up the resulting coated medium in order to form elements that are to be held in place on metal surfaces by magnetic forces acting between the element and a metal surface.

* * * * *